US005647452A

United States Patent [19]

Gauthier

[11] Patent Number: 5,647,452

[45] Date of Patent: Jul. 15, 1997

[54] SCAFFORD JIG

[76] Inventor: Gilbert E. Gauthier, Box 567, Gravelbourg, Saskatchewan, Canada, S0H 1X0

[21] Appl. No.: 529,079

[22] Filed: Sep. 15, 1995

[51] Int. Cl.[6] ..... E06C 1/04

[52] U.S. Cl. ..... 182/117; 182/121; 182/107

[58] Field of Search ..... 182/121, 122, 182/116, 214, 117, 93, 100, 107

[56] References Cited

U.S. PATENT DOCUMENTS

| | | | |
|---|---|---|---|
| 328,999 | 10/1885 | Ballmann | 182/121 |
| 662,566 | 11/1900 | Jones | 182/117 |
| 2,680,554 | 6/1954 | Dakin | 182/214 |
| 3,179,205 | 4/1965 | Rowlette | 182/121 |
| 3,454,132 | 7/1969 | Platino et al. | 182/121 |
| 3,734,236 | 5/1973 | Houlter | 182/214 X |
| 4,121,692 | 10/1978 | Morawski | 182/214 X |
| 4,331,217 | 5/1982 | Stecklow | 182/121 X |
| 4,941,547 | 7/1990 | Livick | 182/117 X |
| 5,373,913 | 12/1994 | Santos | 182/93 X |

FOREIGN PATENT DOCUMENTS

| | | | |
|---|---|---|---|
| 1357779 | 3/1964 | France | 182/122 |
| 1434446 | 2/1969 | Germany | 182/355 |
| 629851 | 9/1949 | United Kingdom | 182/214 |

*Primary Examiner*—Alvin C. Chin-Shue

[57] ABSTRACT

A scaffold jig including a first T-bar that has a first horizontal bar with a first vertical bar extending therefrom. The first vertical bar has a plurality of adjustment holes. Also included is a second T-bar that has a first horizontal U-iron with a second vertical bar extending therefrom. The first U-iron has an opening passing therethrough. The second vertical bar has a bracket with a bracket opening projecting therefrom. The second vertical bar receives the first vertical bar therein to form a support bar. Included is a third T-bar that has a second horizontal U-iron with a third vertical bar extending therefrom. The second U-iron has an opening therethrough and is supported by a step of a ladder. Lastly, a straight bar is included that has a first end positioned between the support bracket, and a second end positioned within the third vertical bar, and a plurality of adjustment holes. The straight bar forms a support brace to support the support bar.

1 Claim, 3 Drawing Sheets

SCAFFORD JIG

BACKGROUND OF THE INVENTION

1. Field of the Invention

The present invention relates to a scaffold jig and more particularly pertains to providing a tool that when used in conjunction with two ladders forms a scaffolding platform and further allowing the scaffold jig to form a scaffolding platform on any two ladders.

2. Description of the Prior Art

The use of scaffolding is known in the prior art. More specifically, scaffolding heretofore devised and utilized for the purpose of providing an elevated working platform for one or more workers are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,332,062 to Revere discloses a simplified scaffold ladder. U.S. Pat. No. 5,181,582 to Meadows discloses a scaffold for an a-frame ladder. U.S. Pat. No. 4,232,759 to Jacobs discloses a mobile ladder-scaffolding system. U.S. Pat. No. 3,997,024 to Fredricks and Smith discloses a portable scaffold ladder. U.S. Pat. No. 3,724,592 to Fleischer discloses an adjustable ladder and scaffold. Lastly, U.S. Pat. No. 3,491,852 to Leist discloses a ladder scaffold.

While these devices fulfill their respective, particular objectives and requirements, the aforementioned patents do not describe scaffold jig that allows any two ladders when used in conjunction with the scaffold jig to form scaffolding that may be placed inside or outside the ladder set-up, to allow the user to locate the scaffold platform where he can reach his work area.

In this respect, the scaffold jig according to the present invention substantially departs from the conventional concepts and designs of the prior art, and in doing so provides an apparatus primarily developed for the purpose of providing a tool that when used in conjunction with two ladders forms a scaffolding platform and further allowing the scaffold jig to form a scaffolding platform on any two ladders.

Therefore, it can be appreciated that there exists a continuing need for a new and improved scaffold jig which can be used for providing a tool that when used in conjunction with two ladders forms a scaffolding platform and further allowing the scaffold jig to form a scaffolding platform on any two ladders. In this regard, the present invention substantially fulfills this need.

SUMMARY OF THE INVENTION

In view of the foregoing disadvantages inherent in the known types of scaffolding now present in the prior art, the present invention provides an improved scaffold jig. As such, the general purpose of the present invention, which will be described subsequently in greater detail, is to provide a new and improved scaffold jig and method which has all the advantages of the prior art and none of the disadvantages.

To attain this, the present invention essentially comprises a first T-bar having a first horizontal bar with a first vertical bar extending ninety degrees therefrom. The first horizontal bar has a pair of bar ends and a pair of rubber pads. The rubber pads are positioned on the first horizontal bar with one pad spaced from one of each bar end. The first vertical bar has a plurality of adjustment holes therethrough.

Included is a second T-bar. The second T-bar has a first horizontal U-iron with a second vertical bar extending ninety degrees therefrom. The first U-iron has a distal side, a proximal side and an opening passing from the distal side through to the proximal side. The first U-iron is positioned over a step of a ladder. The opening of the first U-iron is capable of receiving a locking pin with a chain extending therefrom. The chain has a hairpin clasp attached. The locking pin of the first U-iron is positioned through the opening when the first U-iron is positioned over the step, and the chain of the locking pin extends across and under the step for positioning of the hairpin clasp through the locking pin. Furthermore, the second vertical bar has a proximal end with a first proximal opening spaced therefrom and passing through the second vertical bar. The second vertical bar has a bracket projecting downwardly therefrom. The bracket has a bracket opening passing therethrough. The second vertical bar is in slidable receipt of the first vertical bar to form a support bar, when the first proximal opening is aligned with one of each of the adjustment holes of the first vertical bar. The first proximal opening receives a locking pin with a chain extending therefrom. The chain has a hairpin clasp attached. The locking pin of the second vertical bar passes through the first proximal opening into one of each of the adjustment holes of the first vertical bar. The locking pin locks the first vertical bar into the second vertical bar, when the U-iron is positioned on the step. Included is a third T-bar. The third T-bar has a second horizontal U-iron with a third vertical bar extending ninety degrees therefrom. The second U-iron has a distal side, a proximal side and an opening passing from the distal side through to the proximal side. The second U-iron is positioned on the step of the ladder. The step supporting the second U-iron is below the step supporting the first U-iron. The opening of the second U-iron receives a locking pin with a chain extending therefrom. The chain has a hairpin clasp attached. The locking pin of the second U-iron is positioned through the opening when the U-iron is positioned over the step. The chain of the locking pin extends across and under the step for positioning of the hairpin clasp through the locking pin. The third vertical bar has a proximal end with a second proximal opening spaced therefrom and passing through the third vertical bar. Additionally, a straight bar is provided. The straight bar has a first end and a second end positionable within the third vertical bar, and through the proximal end of the third vertical bar. The straight bar has a plurality of adjustment holes therethrough with one of each of the adjustment holes capable of alignment with the second proximal opening of the third vertical bar. The first end is positioned between the support bracket of the second vertical bar and is retained therein with a nut being passed through the bracket opening and passing through the straight bar. The second end of the straight bar is locked within the third vertical bar by a locking pin. A support brace is formed when the locking pin is positioned through the second proximal opening and one of the adjustment holes of the straight bar. The support brace supports the support bar with a plank positioned thereon for formation of scaffolding. Lastly, a stake is provided. The stake has an upper end and a pointed end for piercing the ground. The stake has a safety link chain attached and spaced from the upper end. The chain has an end link with a locking pin attached. The chain is wrapped around the step of a ladder to return in the direction of the stake with the locking pin positioned through one of the links of the chain. The locking pin is locked in position by a clasp. The stake supports the ladder when the scaffolding is positioned on the ladder and the safety chain is positioned around the step of the ladder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved scaffold jig which has all of the advantages of the prior art scaffolding and none of the disadvantages.

It is another object of the present invention to provide a new and improved scaffold jig which may be easily and efficiently manufactured and marketed.

It is further object of the present invention to provide a new and improved scaffold jig which is of durable and reliable constructions.

An even further object of the present invention is to provide a new and improved scaffold jig which is susceptible of a low cost of manufacture with regard to both materials and labor, and which accordingly is then susceptible of low prices of sale to the consuming public, thereby making such scaffold jig economically available to the buying public.

Still yet another object of the present invention is to provide a new and improved scaffold jig which provides in the apparatuses and methods of the prior art some of the advantages thereof, while simultaneously overcoming some of the disadvantages normally associated therewith.

Even still another object of the present invention is to provide a scaffold jig for providing a tool that when used in conjunction with two ladders forms a scaffolding platform and further allowing the scaffold jig to form a scaffolding platform on any two ladders.

Lastly, it is an object of the present invention to provide a new and improved scaffold jig that includes a first T-bar. The first T-bar has a first horizontal bar with a first vertical bar extending ninety degrees therefrom, and has a plurality of adjustment holes therethrough. Included is a second T-bar. The second T-bar has a first horizontal U-iron with a second vertical bar extending ninety degrees therefrom. The first U-iron has an opening passing therethrough. The second vertical bar has a bracket projecting therefrom. The bracket has a bracket opening. The second vertical bar capable of receiving the first vertical bar therein to form a support bar. Also included is a third T-bar. The third T-bar has a second horizontal U-iron with a third vertical bar extending ninety degrees therefrom. The second U-iron has an opening therethrough and is supported by a step of a ladder. A straight bar is provided. The straight bar has a first end that is positioned between the support bracket of the second vertical bar, and a second end positioned within the third vertical bar, and a plurality of adjustment holes. The straight bar forms a support brace to support the support bar when the first end and the second end are locked in position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 3:
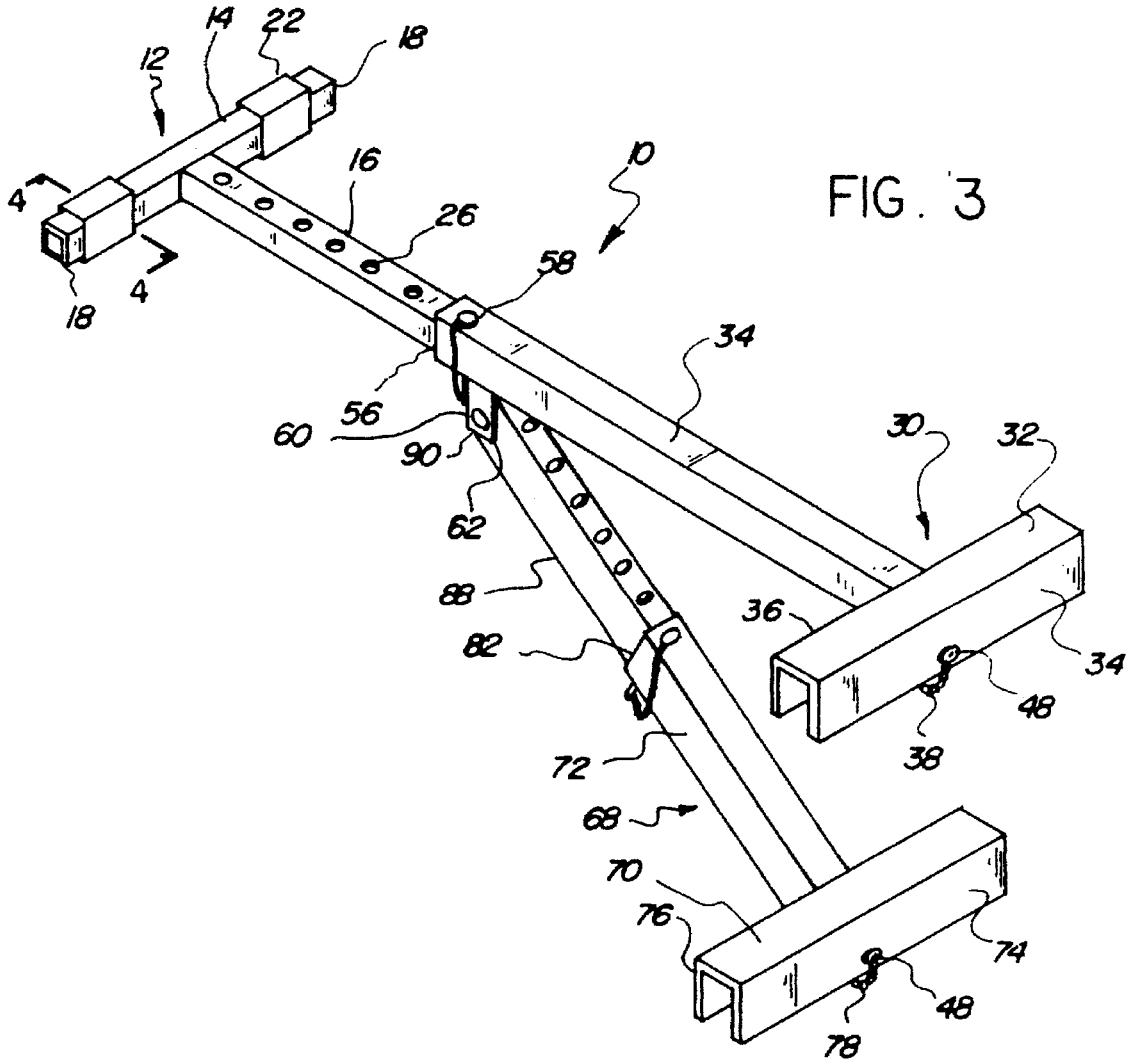
FIG. 3 is an elevated view of the preferred embodiment of the present invention.

With reference now to the drawings, and in particular to FIG. 3 thereof, the preferred embodiment of the new and improved scaffold jig embodying the principles and concepts of the present invention and generally designated by the reference numeral 10 will be described.

The present invention, the scaffold jig 10 is comprised of a plurality of components. Such components in their broadest context include three T-bars, a straight bar, locking pins and a stake with a chain. Such components are individually configured and correlated with respect to each other so as to attain the desired objective.

Figure 4:
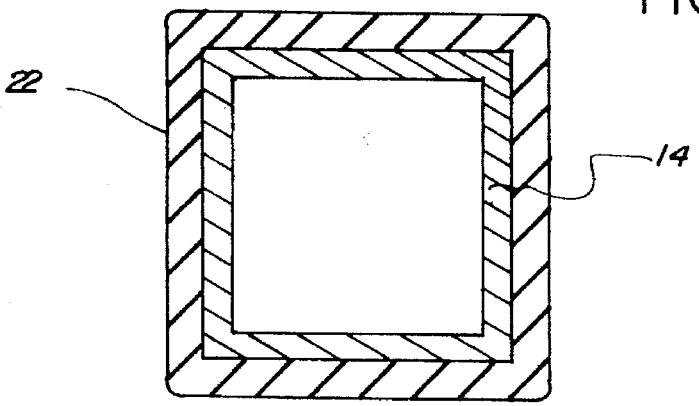
FIG. 4 is a cross-sectional view of the present invention taken along line 4—4 of FIG. 3.

Specifically, the present invention includes a first T-bar 12. The first T-bar as shown in FIG. 3, has a first horizontal bar 14 with a first vertical bar or side bar 16 extending ninety degrees therefrom. The first horizontal bar has a length of 12 inches. The first horizontal bar has a pair of bar ends 18 and a pair of rubber pads 22. FIG. 4 illustrates one of the rubber pads as positioned on the first horizontal bar. The rubber pads are 4 inches in length. The rubber pads are positioned on the first horizontal bar with one pad spaced from one of each bar end. Each rubber pad covers about 33⅓ percent of the length of the first horizontal bar. The first vertical bar has a plurality of adjustment holes 26 therethrough. The first vertical bar has a length of 21 inches. The distance between each adjustment hole of the first vertical bar is 3 inches. This ensures the strength and integrity of the first vertical bar when weight is placed thereon. The first vertical bar is centrally positioned along one side of the first horizontal bar, and extends along a central axis vertical the first horizontal bar.

Figure 5:
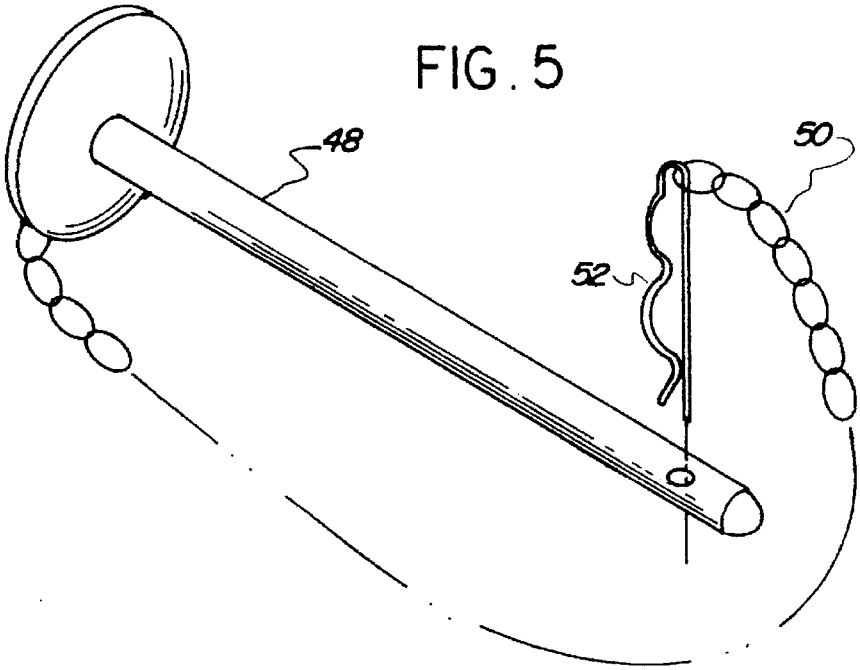
FIG. 5 is an enlarged view of the locking pin and hairpin clasp of the present invention as shown in FIG. 3.

As best illustrated in FIG. 3, a second T-bar 30 is provided. The second T-bar has a first horizontal U-iron 32 with a second vertical bar or side bar 34 extending ninety degrees therefrom. The first U-iron has a length of 12 inches and each side of the "U" have a width of 2 inches. The first U-iron has a distal side 34, a proximal side 36 and an opening 38 passing from the distal side through to the proximal side. The first U-iron is sized for positioning over one of the plurality of steps of the ladder and covering three sides of the one step for reducing excess movement of the first U-iron. The first U-iron is positioned over a step 42 of a ladder 44. The opening of the first U-iron is capable of receiving therein a locking pin 48 with a chain 50 extending therefrom. The locking pin, chain and clasp are best illustrated in FIG. 5. The chain has a hairpin clasp 52 attached thereto. The locking pin of the first U-iron is positioned through the opening 38 when the first U-iron 32 is positioned over the step.

Figure 6:
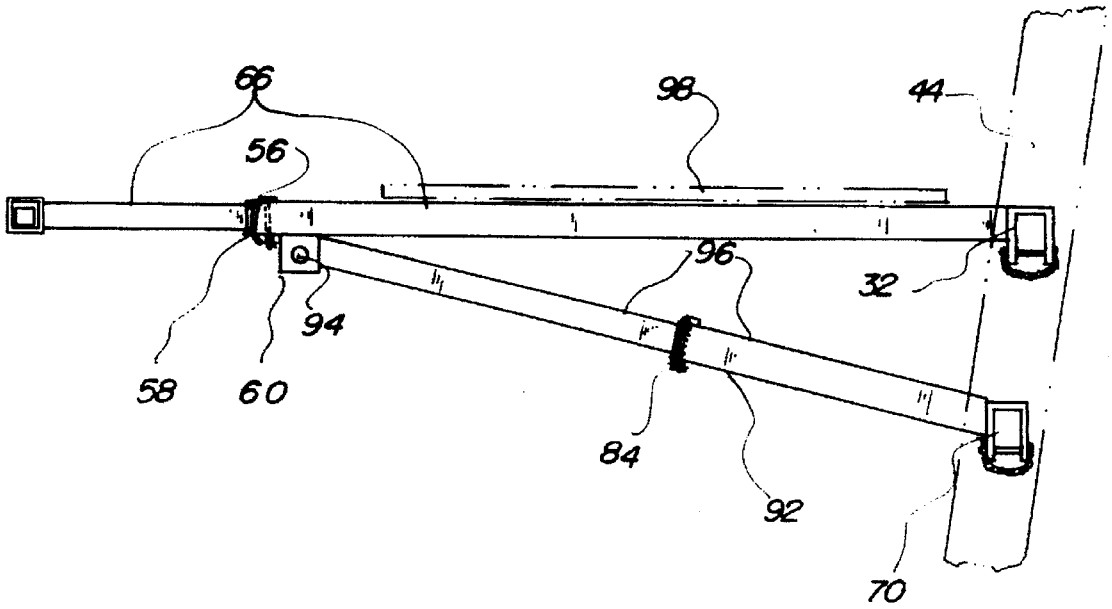
FIG. 6 is a side view of the present invention in an operable configuration.

The chain of the locking pin positioned within the first U-iron 32, extends across and under the step to position the hairpin clasp through the locking pin, as shown in FIG. 6. The locking pin secures the first U-iron onto the step and helps the first U-iron remain thereon when weight is placed on the second vertical bar 34. The chain is a holder for the hairpin clasp. The hairpin clasp, when positioned through the locking pin, ensures the pin remains in position.

The second vertical bar 34 has a proximal end 56 with a first proximal opening 58 spaced therefrom and passing through the second vertical bar. The second vertical bar has a length of 24 inches. The second vertical bar has a bracket 60 projecting downwardly therefrom. The bracket has a bracket opening 62 passing therethrough. The second vertical bar is capable of slidable receipt of the first vertical bar 16 therein. When the first vertical bar is within the second vertical bar, the two form a support bar 66 when the first proximal opening is aligned with one of each of the adjustment holes 26 of the first vertical bar.

Figure 1:
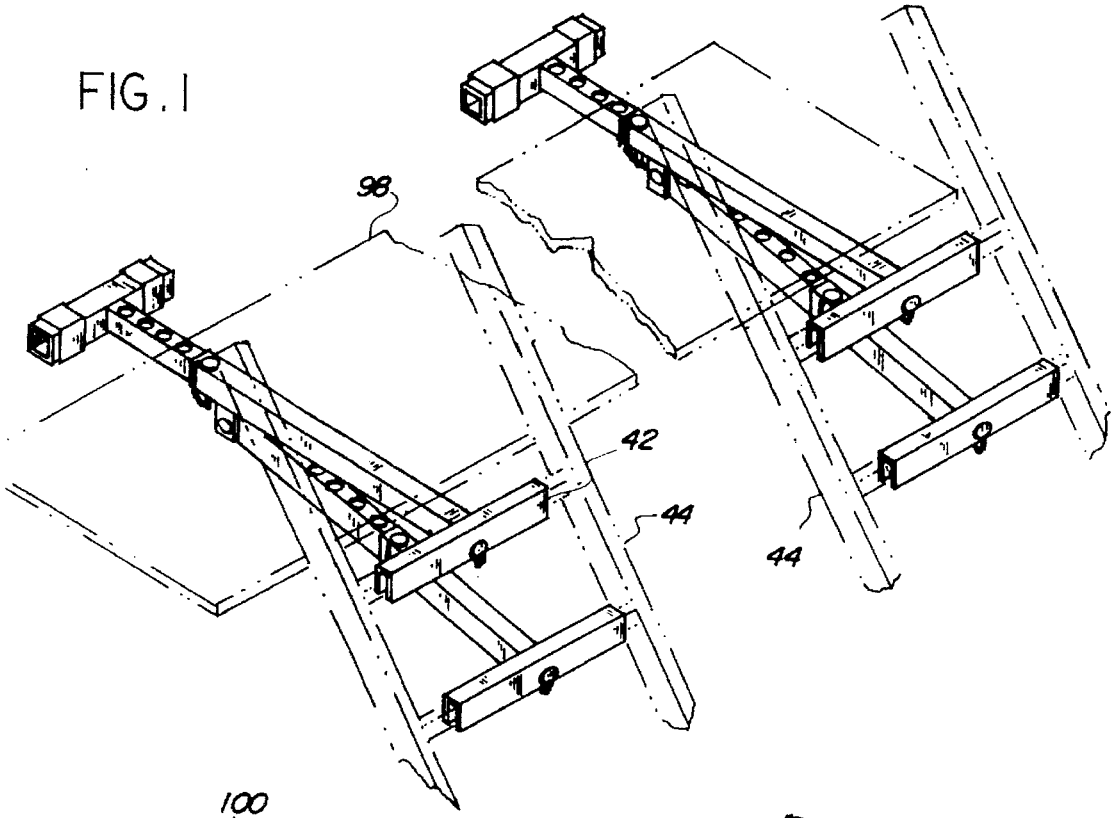
FIG. 1 is a perspective view of the preferred embodiment of the scaffold jig constructed in accordance with the principles of the present invention.

The first proximal opening receives a locking pin 48 therein. The locking pin has a chain 50 extending therefrom, and the chain has a hairpin clasp 52 attached thereto. As shown in FIGS. 1 and 6, the locking pin of the second vertical bar passes through the first proximal opening into one of each of the adjustment holes of the first vertical bar. The locking pin locks the first vertical bar into the second vertical bar, when the first U-iron is positioned on the step. The locking pin is retained within the opening by the hairpin clasp that is placed through the locking pin.

Additionally, a third T-bar 68 is included. The third T-bar has a second horizontal U-iron 70 with a third vertical bar or side bar 72 extending ninety degrees therefrom. The second U-iron has a length of 12 inches and each side of the "U" has a width of 2 inches. The second U-iron has a distal side 74, a proximal side 76 and an opening 78 passing from the distal side through to the proximal side. The second U-iron is positioned on the step of the ladder. The second U-iron is sized for positioning over another of the plurality of steps of the ladder and covering three sides of the other step for reducing excess movement of the first U-iron. The step supporting the second U-iron is below the step supporting the first U-iron. The opening of the second U-iron is capable of receiving a locking pin 48 therein.

The locking pin has a chain 50 extending therefrom. The chain has a hairpin clasp 52 attached thereto. The locking pin of the second U-iron is positioned through the opening 78 when the second U-iron is positioned over the step. The chain of the locking pin is extended across and under the step to position the hairpin clasp through the locking pin. The locking pin secures the second U-iron onto the step and helps the second U-iron remain thereon. The third vertical bar 68 has a proximal end 82 with a second proximal opening 84 spaced therefrom and passing through the third vertical bar. The third vertical bar has a length of 17 inches.

Furthermore, a straight bar 88 is included. The straight bar has a first end 90 and a second end 92 positionable within the third vertical bar 72 through the proximal end 82 of the third vertical bar. The straight bar is about 21 inches in length. The straight bar has a plurality of adjustment holes 26 therethrough. The adjustment holes are spaced from each other a distance of 1½ inch. The first hole of the adjustment holes of the straight bar is about 10 inches from the first end. To ensure stress placed on the straight bar will not cause structural damage. One of each of the adjustment holes is capable of aligning with the second proximal opening 84 of the third vertical bar when the straight bar is positioned therein. The first end is positioned between the support bracket 60 of the second vertical bar and is retained therein with a nut 94. The nut passes through the bracket opening and passing through the straight bar. The nut may be supplied with a bolt in cases where the scaffold jig is to remain in use for long periods of time. The second end 92 of the straight bar is locked within the third vertical bar by a locking pin 48. A support brace 96 is formed when the locking pin is positioned through the second proximal opening 84 and the first end is secured within the bracket of the second vertical bar. The support brace is capable of supporting the support bar with a plank 98 positioned thereon for formation of scaffolding, as shown in FIG. 1.

Figure 2:
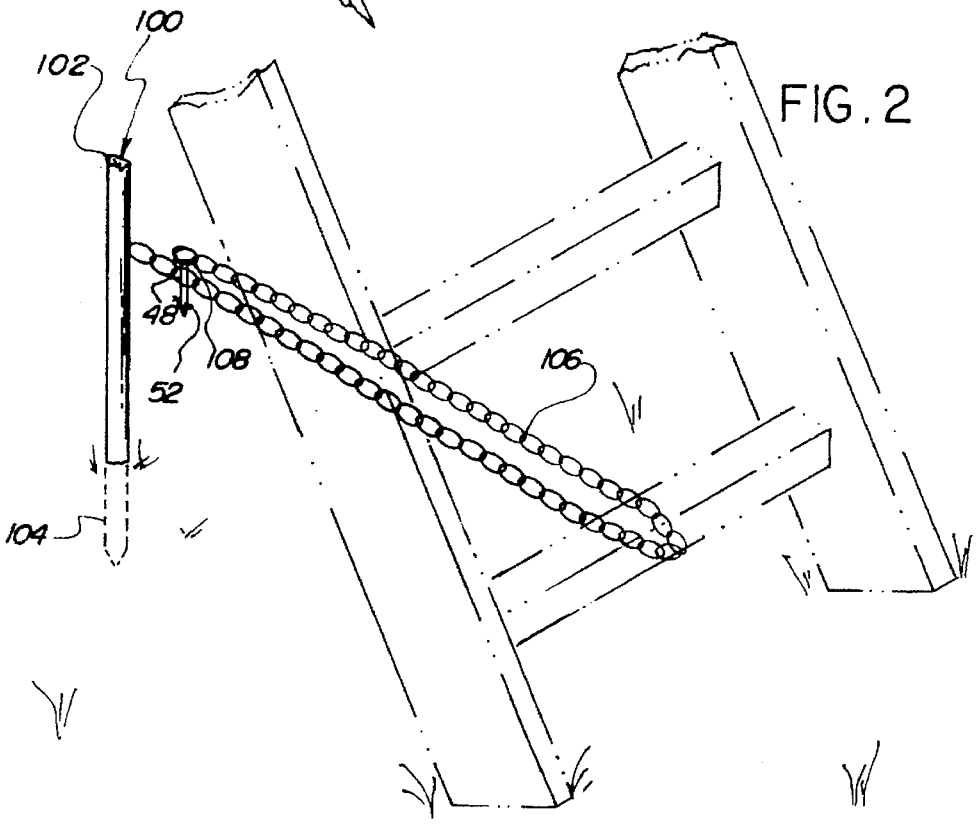
FIG. 2 is a perspective view of the support stake of the preferred embodiment of the present invention.

Lastly, as illustrated in FIG. 2, a stake 100 is included. The stake has a generally cylindrical configuration, and has an upper end 102 and a pointed end 104 for piercing the ground. The stake has a safety link chain 106 attached and spaced from the upper end. The safety chain has an end link 108 with a locking pin 48 attached thereto. The safety chain is wrapped around the step of a ladder and returned in the direction of the stake. The locking pin is then positioned through one of the links of the chain and is locked in position by a clasp. The stake is capable of supporting the ladder when the scaffolding is positioned on the ladder and the safety chain is position around the step of the ladder. The safety chain prevents the ladder from slipping along the ground.

As illustrated in FIG. 1, the scaffolding is formed when two scaffold jig are used. One scaffold jig is positioned on a first ladder and a second scaffold jig is positioned on a second ladder. Once the scaffold jig of each ladder is operable a plank may be positioned thereon. The plank is supported by the support bar which in turn is supported by the ladder and support brace.

Each of the vertical bars is a hollow steel bar that is welded to the respective horizontal bar or U-iron. Each of the locking pins are made of steel. The openings and adjustment holes of the tool each have a diameter of ¼ inch. The locking pins used to secure the scaffold jig at joining point is about 1½ inch long. The diameter of the locking pin is slightly less than the diameter of the openings and adjustment holes.

The present invention provides an easy way to create a scaffolding. The scaffold jig is a tool that is placed on the steps of a ladder to create a generally triangular structure that will support planks. The rubber pads of the first horizontal bar may be used against the side of a building. This will give the scaffold jig additional stability or it will give the user more work space. Because the scaffold jig is adjustable along the ladder steps, its height may be adjusted to fit the job. Additionally, the scaffold jig may be placed on the outside of the ladder and away from the wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved scaffold jig that utilizes two ladders in the creation of scaffolding comprising in combination:

a ladder having a plurality of steps;

a first T-bar having a first horizontal bar with a first side bar extending ninety degrees therefrom, the first horizontal bar having a pair of bar ends and a pair of rubber pads, the rubber pads being positioned on the first horizontal bar with one pad spaced from one of each bar ends, the first side bar having a plurality of adjustment holes therethrough;

a second T-bar having a first horizontal U-iron with a second side bar extending ninety degrees therefrom and rigidly attached thereto, the first U-iron having a distal side, a proximal side and an opening passing from the distal side through to the proximal side, the first U-iron being sized for positioning over one of the plurality of steps of the ladder and covering three sides of the one step for reducing excess movement of the first U-iron, the opening of the first U-iron receiving therein a locking pin with a chain extending therefrom, the chain having a hairpin clasp attached thereto, the locking pin of the first U-iron being positionable through the opening when the first U-iron being positioned over the step and the chain of the locking pin extending across and under the step for positioning of the hairpin clasp through the locking pin, the locking pin securing the first U-iron onto the step and allowing the first U-iron to remain on the step when weight being placed onto the second side bar, the hairpin clasp being positioned through the locking pin to ensure the pin remains in position when weight is placed on the second side bar;

the second side bar having a proximal end with a first proximal opening spaced therefrom and passing through the second side bar, the second side bar having a bracket projecting downwardly therefrom, the bracket having a bracket opening passing therethrough, the second side bar being capable of slidable receipt of the first side bar therein to form a support bar when the first proximal opening being aligned with one of each of the adjustment holes of the first side bar, the first proximal opening receiving therein a locking pin with a chain extending therefrom, the chain having a hairpin clasp attached thereto, the locking pin of the second side bar being capable of passing through the first proximal opening into one of each of the adjustment holes of the first side bar for locking of the first side bar into the second side bar, when the U-iron being positioned on the step;

a third T-bar having a second horizontal U-iron with a third side bar extending ninety degrees therefrom and rigidly attached thereto, the first and second U-irons being adjustably separated from each other to allow folding of the third T-bar relative to the second T-bar, the second U-iron having a distal side, a proximal side and an opening passing from the distal side through to the proximal side, the second U-iron being sized for positioning over another of the plurality of steps of the ladder and cover three sides of the other step reducing excess movement of the second U-iron, the other step of the plurality of steps is below the one step supporting the first U-iron, the opening of the second U-iron receiving therein a locking pin with a chain extending therefrom, the chain having a hairpin clasp attached thereto, the locking pin of the second U-iron being positionable through the opening when the second U-iron being positioned over the other step, the chain of the locking pin extending across and under the step for positioning of the hairpin clasp through the locking pin, the third side bar having a proximal end with a second proximal opening spaced therefrom and passing through the third side bar;

a straight bar having a first end and a second end positionable within the third side bar through the proximal end of the third side bar, the straight bar having a plurality of adjustment holes therethrough with one of each of the adjustment holes being capable of aligning with the second proximal opening of the third side bar, the adjustment holes being spaced one from another at a distance of 1½ inches for ensuring that weight placed on the first side bar and the second side bar does not cause structural damage to the straight bar, the first end being positionable between the support bracket of the second side bar and being retained therein with a nut being passed through the bracket opening and passing through the straight bar, the second end of the straight bar capable of being locked within the third side bar by a locking pin and forming a support brace when the locking pin being positioned through the second proximal opening, the support brace being capable of supporting the support bar with a plank positioned thereon for formation of scaffolding; and a stake having an upper end and a pointed end for piercing the ground, the stake having a safety link chain attached and spaced from the upper end, the safety chain having an end link with a locking pin attached thereto, the safety chain wrapping around the step of the ladder returning in the direction of the stake with the locking pin being positioned through one of the links of the safety chain, and being locked in position by a clasp, the stake anchoring the ladder when the scaffolding being positioned on the ladder and the safety chain being position around the step of the ladder.

* * * * *